US005959544A

United States Patent [19]

Matsuura

[11] Patent Number: 5,959,544

[45] Date of Patent: Sep. 28, 1999

[54] RADIO SELECTION CALL RECEIVER

[75] Inventor: Tatsuya Matsuura, Shizuoka, Japan

[73] Assignee: NEC Corporation, Tokyo, Japan

[21] Appl. No.: 08/753,414

[22] Filed: Nov. 25, 1996

[30] Foreign Application Priority Data

Nov. 27, 1995 [JP] Japan ..... 7-307388

[51] Int. Cl.[6] ..... G08B 5/22

[52] U.S. Cl. ..... 340/825.44; 455/32.1; 455/38.1

[58] Field of Search ..... 340/825.44, 825.47, 340/825.31, 825.34, 825.48; 455/32.1, 38.1

[56] References Cited

U.S. PATENT DOCUMENTS 5,146,217 9/1992 Holmes et al. ..... 340/825.44

FOREIGN PATENT DOCUMENTS 4-114522 4/1992 Japan .
4-115729 4/1992 Japan .
4-246928 9/1992 Japan .
6-216831 8/1994 Japan .
7-226969 8/1995 Japan .
8-237710 9/1996 Japan .

*Primary Examiner*—Michael Horabik
*Assistant Examiner*—Jean B. Jeanglaude
*Attorney, Agent, or Firm*—Young & Thompson

[57] ABSTRACT

A radio selection call receiver with message display includes a control circuit 40 for controlling the display of messages and a secret mode. The receiver determines whether or not secret setting information is included in a received message and whether or not a user has input or transmitted secret cancellation information. The receiver detects all or part of predetermined first information from received messages, and displays at least one second information set beforehand by a user corresponding to the first information. Display is thereby limited to the second information, which a third person cannot identify. This allows the authorized user to identify callers without inputting or transmitting a secret cancellation code.

10 Claims, 7 Drawing Sheets

| ID CODE |
| --- |
| SECRET SETTING CODE |
| SECRET CANCELLATION CODE |

FIG. 2
PRIOR ART

| | PASSWORD |
| --- | --- |
| UI | X X X X |

FIG. 3A
PRIOR ART

| | PASSWORD |
| --- | --- |
| U2 | X X X X |

FIG. 3B
PRIOR ART

FIG. 5A

| | | |
| --- | --- | --- |
| 01-2345-6789 | 9876-54-3210 | FIRST INFORMATION |
| TARO SEINICHI | YAMAO YAMADA | ① SECOND INFORMATION |
| T.S | Y.Y | ② SECOND INFORMATION |

FIG. 5B

| ID CODE | MESSAGE CODE | SECRET SETTING CODE U1 | 6789 |
| --- | --- | --- | --- |

PART OF FIRST INFORMATION

FIG. 5C

| SECRET |
| --- |
| T.S |

FIG. 5D

| ID CODE | MESSAGE CODE | SECRET SETTING CODE U1 |
| --- | --- | --- |

FIG. 5E

| SECRET |
| --- |

RADIO SELECTION CALL RECEIVER

BACKGROUND OF THE INVENTION

The present invention relates to a radio selection call receiver, and in particular, to a radio selection call receiver operative on the reception of a selection call signal including the ID code of the receiver for displaying a message subsequent to the ID code.

A radio selection call receiver (to be referred to as "receiver" hereinafter) is usually carried in a user's pocket or bag. Upon hearing the calling sound, the user presses a display switch and identifies messages personally. However, if the receiver is stolen or mislaid, a third person could see messages in the same way.

Japanese Laid-Open Patent Application No. 4-114522 entitled "Selection Call Receiver and Method for Displaying and Controlling Messages", for example, shows a receiver which maintains received message in secret. This invention is intended to provide a selection call receiver for ensuring security for messages received by the receiver while a user is absent, so that the messages will not be seen by the third person.

That radio selection call receiver comprises a control circuit for executing all the sequence control of the receiver, a radio circuit for receiving radio waves from the base station through an antenna, a demodulation circuit for demodulating signals received by the radio circuit, an ID-ROM for storing the individual number code (the ID code) of the receiver, a speaker driven by a speaker driving circuit to output a call sound, a message memory for storing received message codes, and a message display section for displaying a message when a display switch is pressed.

The control circuit comprises, for example, a microcomputer as a main control section and a message display control means, a secret mode control means, and a determination means as message display control functions.

When a call to the receiver occurs, the message display control means decodes the message code included in the selection call signal and causes a display control circuit to display a corresponding message on a display section. The determination means determines whether or not a received selection call signal includes a secret setting code or a secret cancellation code. When the determination means detects a secret setting code, the secret mode control means sets a secret mode to stop the message display control means from displaying the message. When a secret cancellation code is detected, the secret mode control means cancels the secret mode to permit the message display control means to control the display of message.

However, when the determination means detects a secret setting code and the secret mode control means stop displaying a message, the user has to transmit secret cancellation codes for each message, in order to identify received messages.

SUMMARY OF THE INVENTION

It is, therefore, an object of the present invention to provide a receiver capable of keeping received messages secret even if the receiver is stolen or mislaid, and of identifying a caller without transmitting or inputting secret cancellation codes for each message.

A radio selection call receiver of the present invention comprises a secret setting information detection means for determining whether or not secret setting information is included in a received message, a first information setting means for setting first information, a first information detection means for detecting all or part of said first information from said received message and a second information indicating means for displaying second information set beforehand by a user and corresponding to said first information.

A method of displaying radio selection call signals comprises the following steps. First, secret setting information detection means determines whether or not secret setting information is included in received signals, secret setting information detection means sets a secret mode if the secret setting information is detected, first information detection means detects all or part of predetermined first information from said received message, and second information indicating means displays at least one second information set beforehand by a user and corresponding to said first information.

BRIEF DESCRIPTION OF THE DRAWINGS

The above and other objects, features and advantages of the present invention will become apparent from the following detailed description when taken with the accompany drawings in which:

FIG. 2 typically shows how various codes are stored in an ID-ROM shown FIG. 1.

FIGS. 3A–3B shows the configuration of a secret setting code and a secret cancellation code respectively in the radio selection call receiver.

FIG. 5A shows the correspondence between first information and a plurality of second information, FIG. 5B shows a typical reception message including a secret setting code U1, FIG. 5C shows an example of a display obtained when the message in FIG. 5B is received, FIG. 5D shows a typical reception message without first information. FIG. 5E shows an example of a display obtained when the message in FIG. 5D is received.

DETAILED DESCRIPTION OF THE PREFERRED EMBODIMENT

To better understand the present invention, a brief reference will be made to a conventional radio selection call receiver, shown in FIG. 1, FIG. 2, FIGS. 3A–3B. These figures correspond to the figures shown in the above-discussed Japanese application.

Figure 1:
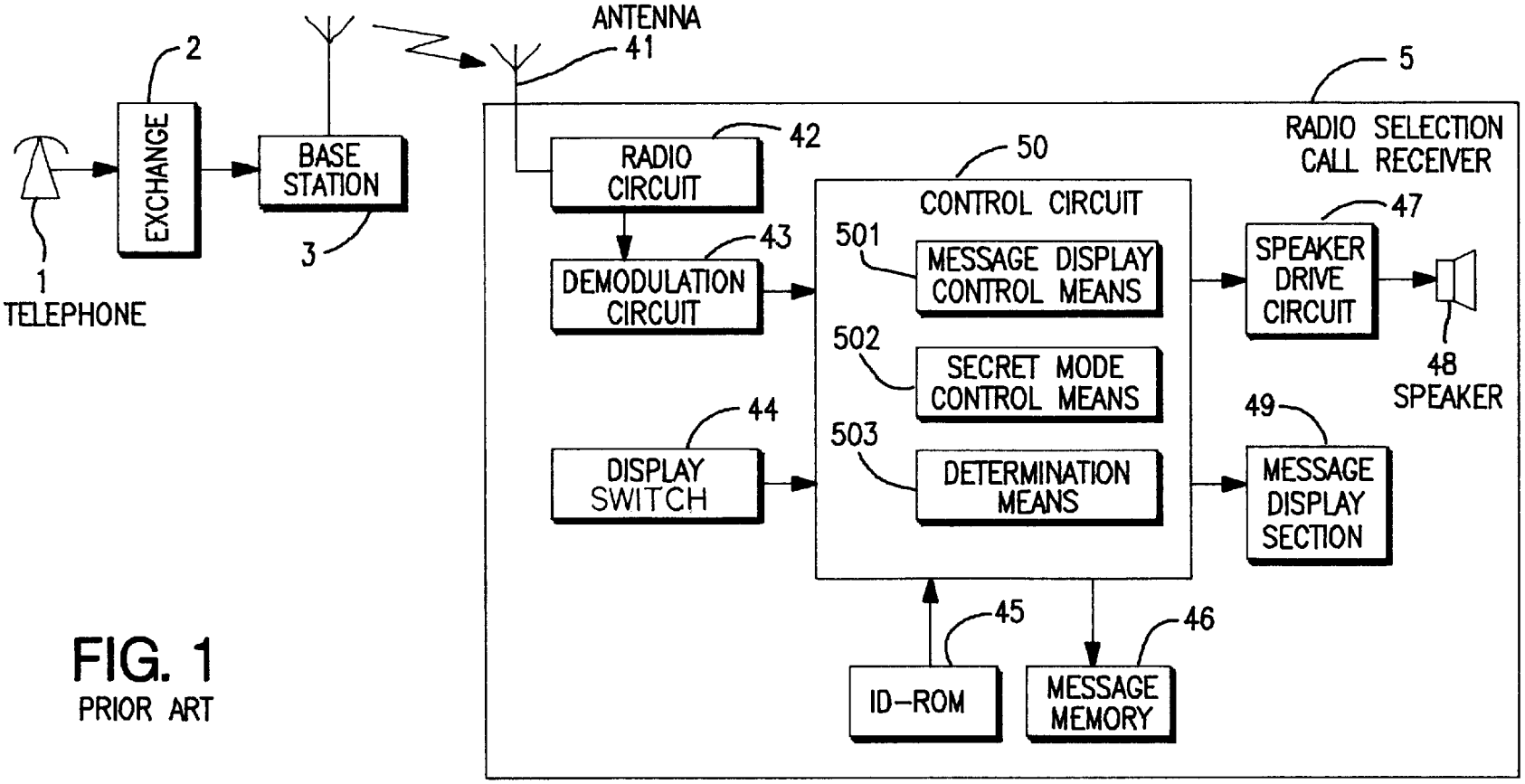
FIG. 1 PRIOR ART
FIG. 1 is a block diagram showing one example of a selection call system including a conventional radio selection call receiver.

Referring to FIG. 1, this conventional selection call reception system comprises a plurality of telephones 1 (only one of which is shown in FIG. 1), an exchange 2 to which these telephones 1 are connected via circuits, a base station 3 connected to the exchange 2, and a radio selection call receiver 5 for carrying out radio communications with the base station 3.

The radio selection call receiver 5 comprises a control circuit 50 for executing all the sequence control of the receiver, a radio circuit 42 for receiving electromagnetic waves from the base station 3 through an antenna 41, a demodulation circuit 43 for demodulating signals received by the radio circuit 42, an ID-ROM 45 for storing the individual number code (the ID code) of the receiver, a speaker 48 driven by a speaker driving circuit 47 to output a call sound, a message memory 46 for storing received message codes, and a message display section 49 for displaying a message when a display switch 44 is pressed.

The ID-ROM 45 stores a secret setting code and a secret cancellation code in addition to the ID code of the receiver, as shown in FIG. 2. The secret setting code comprises, for example, a code U1 indicating that this is a secret setting code and a four-digit password XXXX, as shown in FIG. 3A. The secret cancellation code comprises, for example, a code U2 indicating that this is a secret cancellation code and a four-digit password XXXX, as shown in FIG. 3B.

The control circuit 50 comprises, for example, a microcomputer as a main control section and a message display control means 501, a secret mode control means 502, and a determination means 503 as message display control functions.

When a call to the receiver occurs, the message display control means 501 decodes the message code included in the section call signal and display a corresponding message on a display section 49.

The determination means 503 determines whether or not a received selection call signal includes a secret setting code or a secret cancellation code.

When the determination means 503 detects a secret setting code, the secret mode control means 502 sets a secret mode to stop the message display control means 501 from controlling the display of message. When a secret cancellation code is detected, the secret mode control means 502 cancels the secret mode to permit the message display control means 501 to control the display of message.

As described above, a user can transmit a secret setting code to his or her receiver and stop displaying messages, even if the receiver is stolen or mislaid. However, the user cannot identify messages without transmitting a secret cancellation code for each message.

Figure 4:
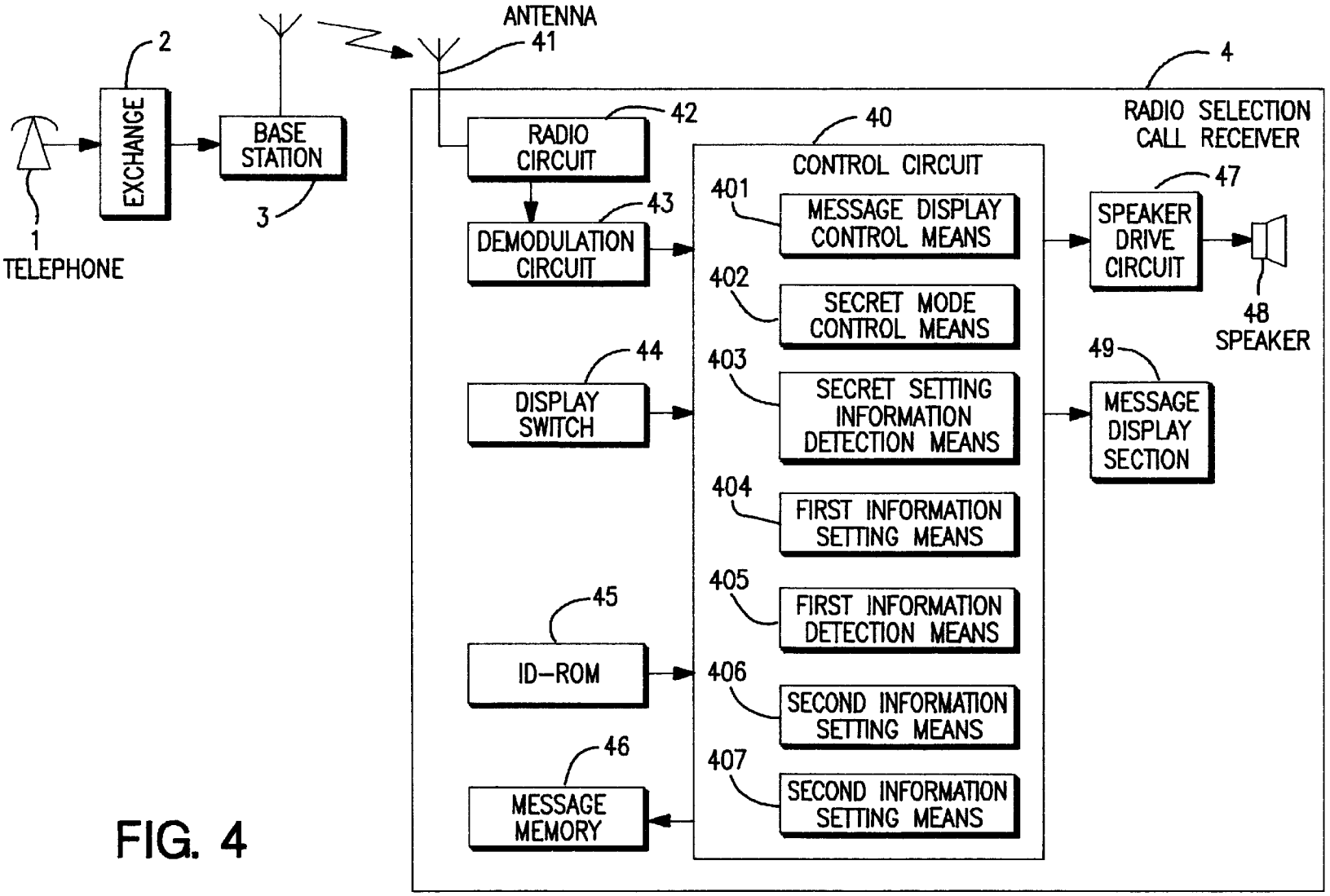
FIG. 4 is a block diagram showing one embodiment of a radio selection call system including a radio selection call receiver according to this invention.

Referring to FIG. 4 a radio selection call receiver embodying the present invention is shown. FIG. 4 is a block diagram showing one embodiment of a radio selection call system including a radio selection call receiver according to this invention.

In FIG. 4, those components which are the same as in the conventional system have the same reference numerals as in FIG. 1. That is, a selection call reception system according to this embodiment comprises a plurality of telephones 1 (only one of which is shown in FIG. 4), an exchange 2 to which these telephones 1 are connected via circuits, a base station 3 connected to the exchange 2, and a radio selection call receiver 4 for carrying out radio communications with the base station 3.

The radio selection call receiver 4 comprises a control circuit 40 for executing all the sequence control of the receiver, a radio circuit 42 for receiving electromagnetic waves from the base station 3 through an antenna 41, a demodulation circuit 43 for demodulating signals received by the radio circuit 42, an ID-ROM 45 for storing the individual number code (the ID code) of the receiver, a speaker 48 driven by a speaker driving circuit 47 to output a call sound, a message memory 46 for storing received message codes, and a message display section 49 for displaying a message when a display switch 44 is pressed.

The control circuit 40 comprises, for example, a microcomputer as a main control section, a message display control means 401 for controlling the display of messages, a secret mode control means 402, a secret setting information detection means 403 for determining whether or not secret setting information is included in a received message and whether or not the user has operated the switch to input secret cancellation information, a first information setting means 404 for setting first open information, a first information detection means 405 for detecting all or part of first information in a received message, a second information display means 406 for displaying second information set beforehand by the user when the first information detection means 405 detects all or part of first information, and a second information setting means 407 for selecting and setting information to be displayed by the second information display means 406, from a plurality of second information corresponding to each of the first information and comprising information describing the first information in detail and information for maintaining the first information confidential.

When a call to the receiver occurs, the message display control means 401 decodes the message code included in the selection call signal and causes a corresponding message to be displayed on a display section 49.

When the secret setting information detection means 403 detects secret setting information, the secret mode control means 402 stops the message display control means 401 from controlling the display of the message. When the first information detection means 405 detects all or part of first information set by the first information setting means 404, the secret mode control means 402 causes second information set by the second information display means 406 to be displayed.

FIGS. 5A–5E show an example of the configuration of a message including secret setting information according to this embodiment shown in FIG. 4.

FIG. 5A shows the correspondence between first information and a plurality of second information. For example, the two second information corresponding to the first information "01-2345-6789"(a phone number) are "Taro Seinichi", which describes the first information in detail, and "T.S", which is used to maintain received messages confidential. Other letters could be used, but the user must identify these. The "Taro Seinichi" is a caller's name and "T.S." is a initial of the name which a third person cannot identify. A table, for example as shown in FIG. 5A, is stored in the recorder.

FIG. 5B shows a typical received message including a secret setting code U1, and FIG. 5C shows an example of a display obtained when the message in FIG. 5B is received. A caller transmits all or part of first information set beforehand by a user with other codes.

FIG. 5D shows a typical received message without first information, and FIG. 5E shows an example of a display obtained when the message in FIG. 5D is received.

As shown in FIG. 5A, the plurality of second information corresponding to the first information set by the first information setting means 404 are selected and set by the second information setting means 407.

When a selection call signal is received and the secret setting information detection means 403 detects in the received message a secret setting code U1 containing secret setting information as shown in FIG. 5B, the secret mode control means 401 stops the message from being displayed on the message display section 49. The first information detection means 405 determines whether or not the received message includes all or part of the first information. When the first information detection means 405 detects, for example, "6789", which is part of the first information, the second information display means 406 displays on the message display section 49 second information corresponding to the first information, as shown in FIG. 5C.

In this embodiment, the second information includes two sets of data corresponding to the first information; that is, second information 1 describes the first information in detail, while second information 2 is the one which a third person can not identify. The second information display means 406 displays the second information 2. In FIG. 5C, it displays "-SECRET-T.S".

As shown in FIG. 5D, when a message including a secret setting code U1 is received without all or part of the first information, the secret mode control means 402 stops the display of the message. The first information detection means 405, however, determines that all or part of the first information is not included, and causes the message display control means 401 to display "-SECRET-" which only shows that secret information has been received.

When the user inputs or transmits a secret cancellation code U2 containing secret cancellation information and the secret setting information detection means 403 detects this secret cancellation code U2, the secret mode control means 402 cancels the secret mode for the message set as secret in order to permit the message display control means 401 to display the message on the message display section 49.

Figure 6A:
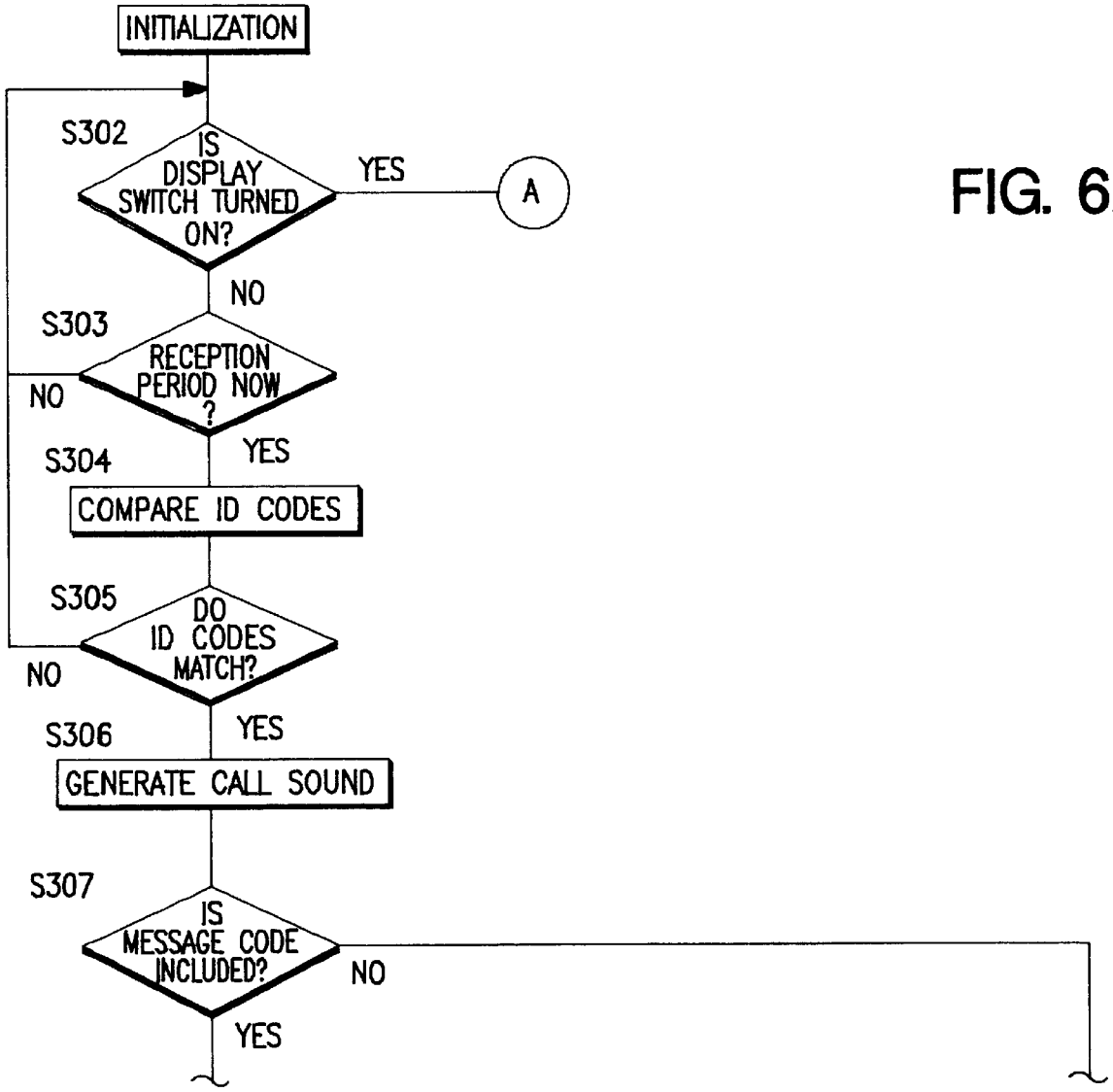
FIG. 6 is a flowchart showing the overall control procedure according to the embodiment shown in FIG. 4.
Figure 6B:
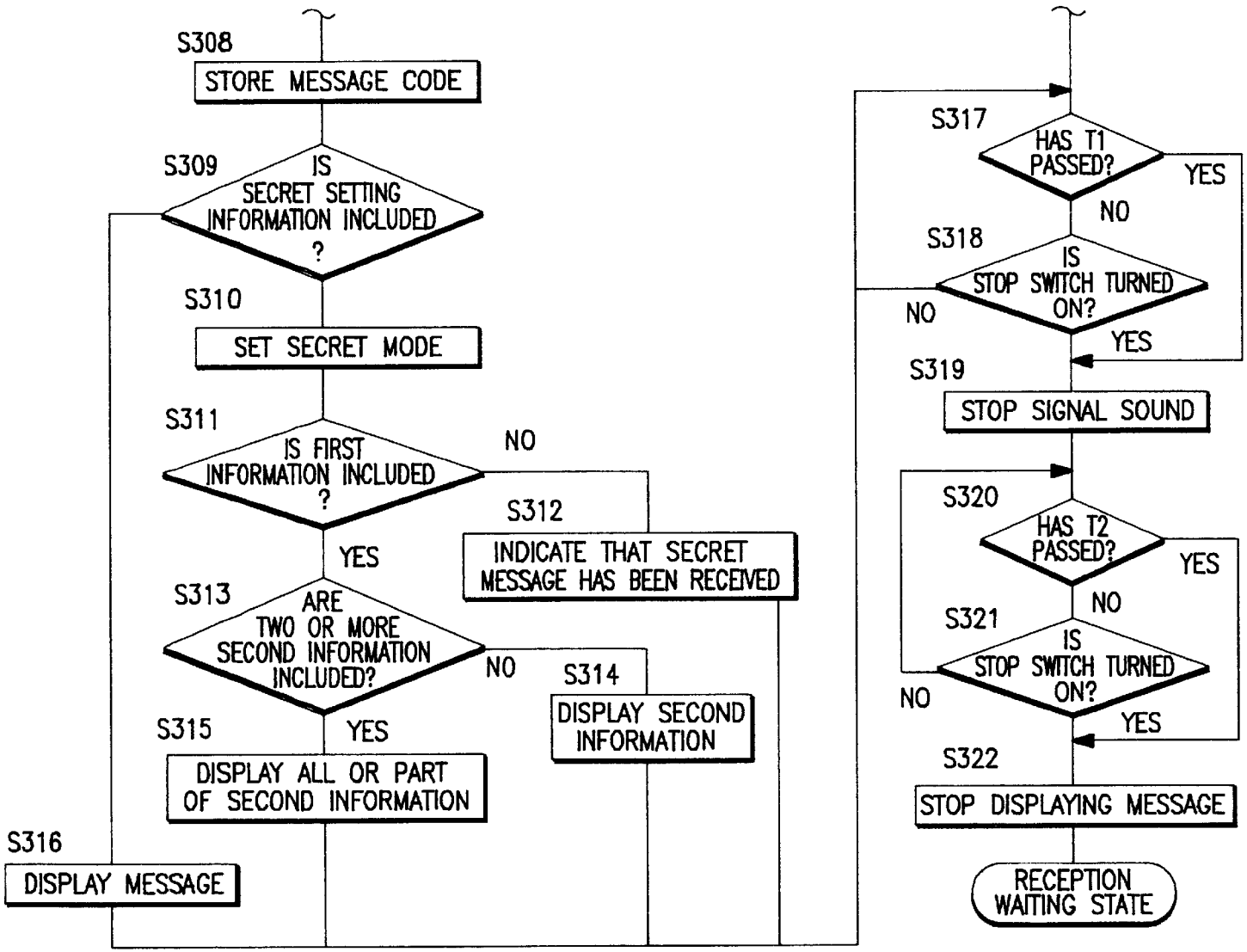
Figure 7A:
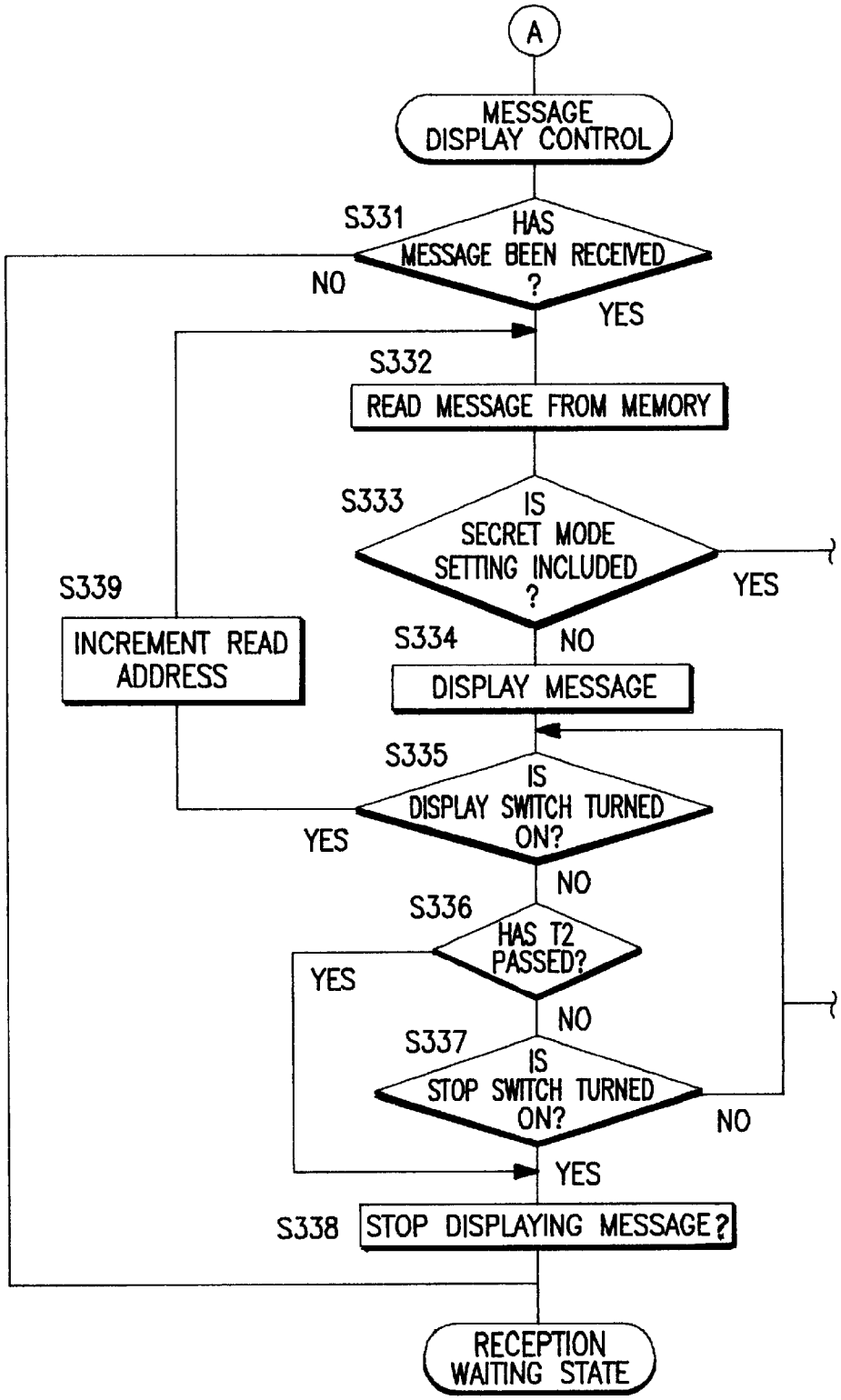
FIG. 7 is a flowchart showing the message display control procedure according to the embodiment shown in FIG. 4.
Figure 7B:
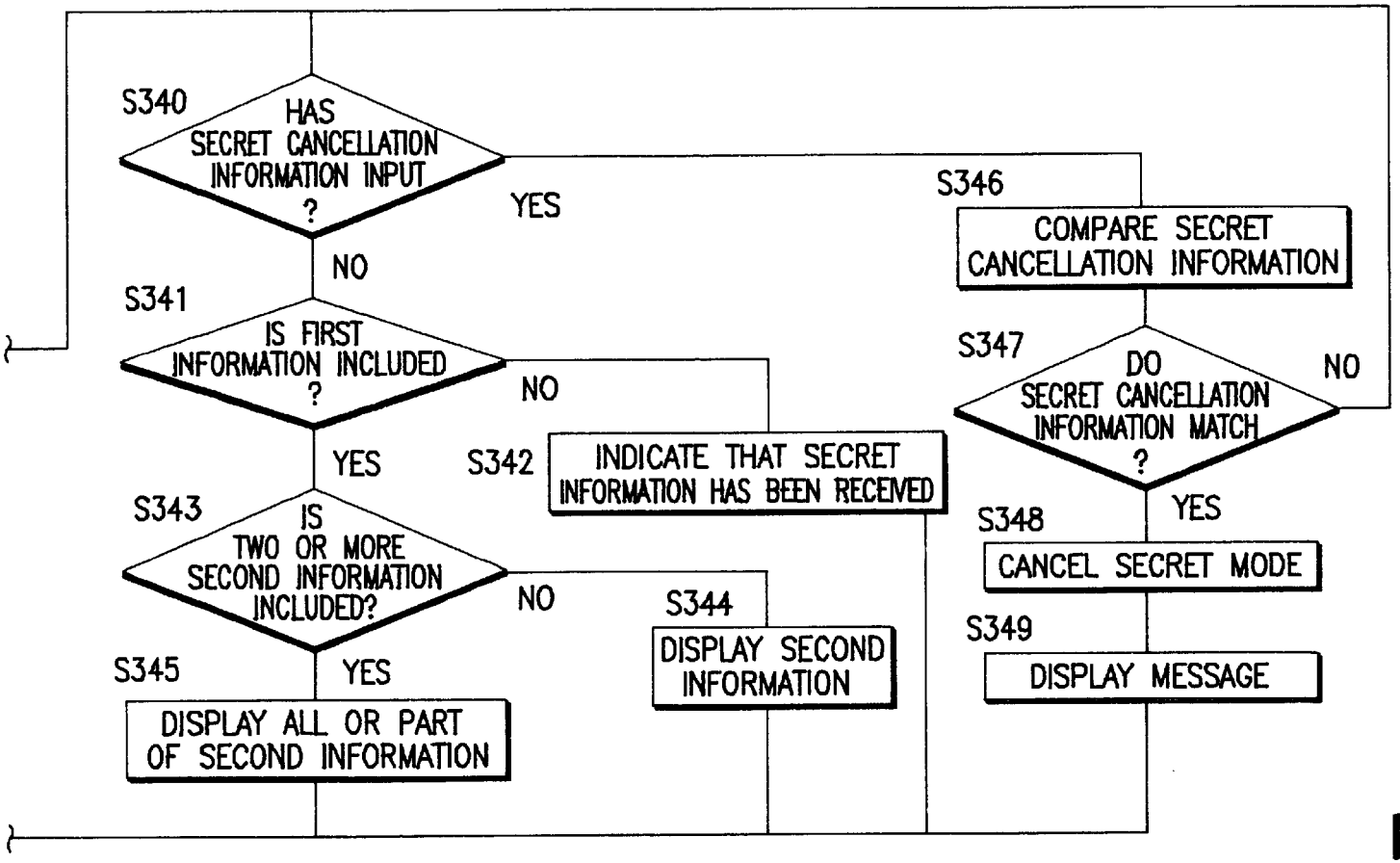

Next, the operation of this embodiment is explained with reference to both FIG. 6 and FIG. 7. FIG. 6 is a flowchart showing the overall control procedure of the embodiment shown in FIG. 4, and FIG. 7 is a flowchart showing the message display control procedure of the embodiment shown in FIG. 4.

When power to the radio selection call receiver 4 is turned on, the control circuit 40 carries out initialization and the receiver enters a reception waiting state (step S301). During the initialization, for example, the control circuit 40 is initialized, synchronization for selection call signals that may be transmitted from the base station 3 is established, and the reception period of the receiver is set to save the battery.

When the receiver enters the call waiting state in S301, the radio selection call receiver 4 uses the control circuit 40 to repeatedly monitor the turning-on and -off of the display switch 44 (S302) and the arrival of the reception period (S303). When the receiver must be ready for reception (the YES branch from S303), a battery saving circuit (not shown) sets the radio circuit 42 and the demodulation circuit 43 to an operative condition to allow the reception of selection call signals that may be transmitted from the base station 3 during this period.

Assume that a normal selection call signal including a message code is transmitted to the receiver. First, the control circuit 40 compares the ID code included in the selection call signal to the ID code of the receiver which is stored in the ID-ROM 45 (S304) in order to determine whether or not the codes match(S305). When the result of the determination in S305 is positive, that is, the received ID code matches the ID code of the receiver, the control circuit determines that a call to the receiver has occurred and generates a call sound (S306).

The control circuit 40 also determines whether or not a message code is included in the received selection call signal, and if so (the YES branch of S307), the control circuit 40 stores the received message code in the message memory (S308).

The control circuit 40 determines whether or not secret setting information is included in the message code (S309). If no secret setting information is included in the message code (the NO branch of S309), then the control circuit 40 proceeds to S316 to decode the received message code and to display it on the message display section 49. That is, a normal message display operation is performed.

In this state, the control circuit 40 also repeatedly determines whether or not a period of time T1 (for example, 10 seconds) has passed since the generation of the call sound (S317) and whether or not a stop switch (not shown) has been pressed (S318). If the result of the determination in S319 is positive, that is, the period of time T1 has passed or the stop switch has been pressed during this period (the YES branch of S317 or S318), then the control circuit 40 stops the generation of the signal sound (S319), and repeats the determination of whether or not a period of time T2 (for example, 20 seconds) has passed since the generation of the signal sound (S320) and the monitoring of the turning-on of the stop switch (S321). If the result of the determination in S320 is positive, that is, the period of time T2 has passed or if the result of the determination in S321 is positive, that is, the stop switch has again been pressed, then the control circuit 40 stops the display of the message (S322) and returns to a reception waiting state.

If the result of the determination in S309 is positive, that is, secret setting information is detected, then the control circuit 40 sets the secret mode (S310), and determines whether or not all or part of the first information is included in the received selection call signal (S311). If all or part of first information is not detected (the NO branch of S311), then the control circuit 40 displays only information indicating that a secret message has been received (S312).

If the result of the determination in S311 is positive, that is, all or part of the first information is detected, then the control circuit 40 determines whether one or two or more second information corresponding to the received first information have been set (S313). If the result of the determination in S313 is negative, that is, the control circuit determines that one second information has been set, then this second information is displayed (S314) In this case, the second information is the one which a third person can not identify or understand. If the result of the determination in S313 is positive, that is, the control circuit determines that two or more second information have been set, then all or part of this second information is displayed (S315).

After these displaying operations (S312, S314 and S315), the control circuit 40 transfers the operation to S317.

The message display control operation will now be described. The user may press the display switch at any time. In this embodiment, flowchart FIG. 6 shows the display switch is pressed in the reception waiting state.

When the user presses the display switch 44 during the reception waiting state, the control circuit 40 determines whether or not a message code is stored in the message memory 46 (S331) , and if so (the YES branch of S331), reads it from the memory 46 and determines whether it includes secret setting information (S333). If a message code is not stored in the message memory 46 (the NO branch of S331), the receiver return to the reception waiting state.

If the result of the determination in S333 is negative, that is, the message code does not include secret setting information, then the control circuit 40 decodes the message code to cause a corresponding message to be displayed (S334).

If the result of the determination in S333 is positive, that is, the message code includes secret setting information, then the control circuit checks whether or not secret cancellation information has been input (S340).

If secret cancellation information has not been input (the No branch of S340), then the control circuit determines whether or not all or part of the first information is included (S341). If all or part of the first information has not been detected (the NO branch of S341), then the control circuit only displays information indicating that secret information has been received (S342).

If the result of the determination in S341 is positive, that is, all or part of the first information has been detected, then the control circuit 40 determines the number of set second information corresponding to the detected first information (S343). If the result of the determination in S343 is positive, that is, two or more second information have been set, then the control circuit 40 causes all or part of the information to be displayed (S345). If only one second information has been set (the NO branch of S343), this second information is displayed (S344).

In these cases, the most recently received message code is selected and read.

In this state, the control circuit 40 repeatedly monitors the re-operation of the display switch 44 (S335) and the turning-on and -off of the stop switch (S337). If the result of the determination in S335 is positive, that is, the display switch 44 is turned on, the control circuit 40 increments the read address (S339), and then returns to S332 to read the next most recent message from the message memory 46. The control circuit 40 subsequently performs similar operations each time the display switch 44 is pressed.

If a single message has been displayed for the period of time T2 (the YES branch of S336) or the stop switch has been pressed during the period of time T2 (the YES branch of S337), then the control circuit 40 stops the display of the message (S338) and returns to the reception waiting state.

The secret cancellation operation will now be explained. The user inputs and stores, for example, a four-digit number beforehand as secret cancellation information by operating the switch. When, under this condition, (the YES branch of S340), a message set as secret is received, the user operates the switch to input the secret cancellation code U2. The user may transmit the secret cancellation code U2.

The control circuit 40 then compares the preset secret cancellation information to the secret cancellation code U2 input by the user (S346), and if they match (the YES branch of S347), cancels the set secret mode (S348) and causes the message set as secret to be displayed on the message display section 49 (S349). In the embodiment above-mentioned, the user has to input the message cancellation code U2 for each message. However, the receiver may be made to allow the user to cancel the secret mode by one inputting of the secret cancellation code U2.

As described above, according to this embodiment, even when a selection call signal including a message code is received, security for the message is ensured depending on the caller's intention, thereby preventing a third party other than the user from seeing the full message.

In addition, since the second information corresponding to the first information in the received selection call signal is automatically displayed, only the user can easily confirm the contents of the received information, and this without inputting a secret cancellation code for each message.

Furthermore, a plurality of secret setting information can be used to select and display desired information from a plurality of the second information. For example, when the secret setting information is A, the second information 1 can be called to display detailed information, that is, a full name, whereas when the secret setting information is B, the second information 2 can be called to display the initials of the name in order to maintain it confidential, as shown in FIG. 5A. Alternatively, other secret setting information X can make all second information display.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A radio selection call receiver for displaying a message comprising:

secret setting information detection means for determining whether or not secret setting information is included in a received message;

information setting means for setting first and second information, said second information being suggestive of said first information;

first information detection means for detecting whether all or part of said first information is contained in said received message; and second information indicating means for displaying the second information corresponding to said detected first information.

2. The radio selection call receiver according to claim 1, wherein said second information includes at least one information which a third party other than a user cannot identify.

3. The radio selection call receiver according to claim 1, wherein said second information corresponding to said first information comprises a plurality of sets of data.

4. A method of displaying a message received at a selective call receiver, comprising the steps of:

evaluating a message received at a selective call receiver to determine whether message is secret;

entering a secret mode of operation if the message is secret;

upon entering the secret mode of operation, evaluating the message to determine whether the message includes first information;

if the message does not include the first information, displaying an indication that the message has been received and not displaying the message; and if the message does include the first information, displaying the indication that the message has been received and second information that corresponds to the first information and not displaying the message, wherein a user with knowledge of the correspondence of the second information and the first information can determine that the received message is secret and includes the first information.

5. The method of claim 4, wherein the first information includes two sections, and wherein the second information includes two sections, each corresponding to a different one of the two sections of the first information, and in the step when the message does include the first information, displaying the one or two sections of the second information corresponding to the one or two sections of the first information included in the message.

6. The method of claim 4, before receipt of the message, further comprising the step of setting the second information corresponding to the first information in the selective call receiver.

7. The method of claim 4, wherein the first information comprises a telephone number and the second information comprises initials related to an entity associated with the telephone number.

8. A selective call receiver comprising:

means for evaluating a message received at a selective call receiver to determine whether the message is secret;

means for evaluating the message to determine whether the message includes first information, when the message is secret;

means for displaying an indication that the message has been received and for not displaying the message, when the message is secret;

means for including in the displayed indication second information that corresponds to the first information when the message includes the first information, wherein a user with knowledge of the correspondence of the second information and the first information can determine that the received message is secret and includes the first information.

9. The receiver of claim 8, further comprising means for setting the first and second information.

10. The receiver of claim 8, wherein the first information includes two sections, and wherein the second information includes two sections, each corresponding to a different one of the two sections of the first information, and wherein said means for including comprises means for including in the displayed indication the one or two sections of the second information corresponding to the one or two sections of the first information included in the message.

* * * * *